US008613112B2

(12) United States Patent
Santucci et al.

(10) Patent No.: US 8,613,112 B2
(45) Date of Patent: Dec. 24, 2013

(54) ARTICLE OF CLOTHING PARTICULARLY INTENDED TO BE USED ALONG WITH ELECTRONIC DEVICES

(75) Inventors: Massimiliano Santucci, Argelato (IT); Domenico Santucci, Argelato (IT)

(73) Assignee: Massimiliano Santuccio, Argelato (Bologna) (IT)

( * ) Notice: Subject to any disclaimer, the term of this patent is extended or adjusted under 35 U.S.C. 154(b) by 183 days.

(21) Appl. No.: 12/994,775

(22) PCT Filed: May 25, 2009

(86) PCT No.: PCT/EP2009/056266
§ 371 (c)(1),
(2), (4) Date: Jan. 31, 2011

(87) PCT Pub. No.: WO2009/150026
PCT Pub. Date: Dec. 17, 2009

(65) Prior Publication Data

US 2011/0185469 A1 Aug. 4, 2011

(30) Foreign Application Priority Data

May 28, 2008 (IT) ..... BO2008A0338

(51) Int. Cl.
*A41D 1/04* (2006.01)
*A41D 27/20* (2006.01)

(52) U.S. Cl.
USPC ..... 2/69; 2/115; 2/247

(58) Field of Classification Search
USPC ..... 2/94, 108, 115, 247, 69, 93, 125, 2/249–253, 270; 381/374, 380, 301, 388; 361/679.03; 439/37
See application file for complete search history.

(56) References Cited

U.S. PATENT DOCUMENTS

| | | | | |
|---|---|---|---|---|
| 6,324,053 | B1 | 11/2001 | Kamijo | |
| 6,561,814 | B2 * | 5/2003 | Tilbury et al. | 439/37 |
| 6,792,124 | B2 * | 9/2004 | Tilbury et al. | 381/333 |
| 6,826,782 | B2 * | 12/2004 | Jordan | 2/94 |
| 7,168,098 | B2 * | 1/2007 | West | 2/93 |
| 7,519,192 | B1 * | 4/2009 | Laycock et al. | 381/301 |
| 7,673,348 | B2 * | 3/2010 | Williams | 2/115 |

(Continued)

FOREIGN PATENT DOCUMENTS

| | | | |
|---|---|---|---|
| JP | 2003 013317 A | 1/2003 | |
| WO | WO2008/133856 A | 11/2008 | |

OTHER PUBLICATIONS

International Search Report, Oct. 1, 2009.

*Primary Examiner* — Amy Vanatta
(74) *Attorney, Agent, or Firm* — William J. Sapone; Ware Fressola Maguire & Barber LLP

(57) ABSTRACT

An article of clothing comprises a garment (11) for covering at least partially the bust of the user wearing the garment. The garment has a case (2) for at least an electronic device (3) provided with controls for setting its functioning. The case (2) has a transparent window (4) which allows the user to see what is contained in the case (2), and which is deformable so that the user can manually actuate the controls. The case is fixed on the outer side of the garment (11), at the bust or upper limbs of the user, in such a position and an arrangement that it can be reached directly by the sight of the user so that he/she can see therein through the window (4).

5 Claims, 1 Drawing Sheet

(56) References Cited

U.S. PATENT DOCUMENTS

| | | | | |
|---|---|---|---|---|
| 2002/0197960 | A1 | 12/2002 | Lee | |
| 2004/0154076 | A1 | 8/2004 | Yoo | |
| 2005/0114988 | A1* | 6/2005 | Dow | 2/247 |
| 2006/0075537 | A1 | 4/2006 | Tsai | |
| 2007/0245444 | A1 | 10/2007 | Brink | |
| 2008/0184459 | A1* | 8/2008 | Barnes | 2/249 |
| 2008/0267440 | A1* | 10/2008 | Alden | 381/385 |
| 2010/0175161 | A1* | 7/2010 | Jarboe | 2/69 |
| 2010/0287677 | A1* | 11/2010 | Alexander | 2/50 |
| 2012/0201412 | A1* | 8/2012 | Del Prete | 381/374 |

* cited by examiner

ARTICLE OF CLOTHING PARTICULARLY INTENDED TO BE USED ALONG WITH ELECTRONIC DEVICES

TECHNICAL FIELD

The present invention relates to the technical field concerning the articles of clothing apt to cover the bust of the user wearing it, such for example but not limited to sweaters, T-shirt, jumpers, shirts, blouses, overcoats, raincoats, waxed jackets, vests, jackets, coats, waistcoats, polo shirts, tops etc. . . .

BACKGROUND ART

Particularly referring to the field of sporting activities, both professional and amateur, by way of example and solely for the sake of a clearer description, it is a common experience the remarkable discomfort caused by the fact that it is not possible to bring along, i.e. during the same sporting activity, those widely and frequently daily used electronic devices (cellphone, portable music player, PDA, etc. . . . ).

Generally, the user of such electronic devices attempts to obviate this discomfort by further bringing along a so-called "bumbag" or a so-called "mono-shoulder bag", where to accommodate the devices.

Such a measure has however remarkable drawbacks, which are described in the following.

First of all, bumbags and mono-shoulder bags represent an extra weight and an encumbrance in addition to the same electronic devices, thus accelerating the fatigue and compromising the sporting performance of the user, and they usually prevent his/her complete freedom of movements as well.

Another significant drawback is the fact that the market scarcely offers earphone devices, whose cables connecting to the provided audio outputs of the aforementioned electronic device, which is accommodated for example in the bumbag anchored at waist, are sufficiently long so that the user can easily perform bust or neck torsions, without such cables resist thereto and without the user remaining substantially bridled; thus compromising not only the performances but above all the enjoyment of the same sporting activity.

Finally, another drawback is the fact that in order to control the electronic device functioning, usually by means of a numeric keypad or a buttons set or also a tactile screen (more commonly known as "touch screen"), the user needs to take the device out from the bumbag or shoulder-bag to visually check his/her proper handling of such controls, this leading the user to be distracted from the sporting activity he/she is performing, and to frequently interrupt it in order to fully concentrate on the same device.

SUMMARY OF THE INVENTION

Therefore, an object of the present invention is to solve the aforementioned drawbacks and others more by providing an article of clothing, according to claim 1, comprising a garment apt to cover at least partially the bust of the user wearing it, and further comprising at least a case, which is particularly intended to accommodate at least an electronic device provided with controls for setting its functioning, the case comprising in turn a transparent window which allows to see what is contained in said case, and which is deformable so that said user, by manually acting on the same, can actuate said controls; the case being fixed on the outer side of said garment, at the bust or upper limbs of the user, in such a position and an arrangement that it can be reached directly by the sight of the user so that he/she can see therein through the window.

Since the inventive article of clothing is suitably provided with a case for the electronic devices, the present invention fully obviates the drawback due to the usage of the aforementioned bumbag and mono-shoulder bag, which implies additional weight and encumbrance with respect to the same electronic devices.

Moreover, in case the user wants to use earphone devices connected via cable to the electronic device accommodated in the case, this one being arranged at either the bust (preferably the trunk) or upper limbs, he/she can freely perform even impulsive torsions of the shoulders, bust or neck, without being subjected to the aforementioned resistance to such movements caused by the connecting cable (the practical arrangement and usage thereof will be better described in the following, with reference to a preferred embodiment of the invention).

In addition, since the inventive article is advantageously provided with said transparent and deformable window, arranged at a position which is easily reachable by the hands and the sight of the user, he/she can actuate the controls of the device in a suitable, efficient and not "blindly" way, thus evaluating what is represented on possible visualizing means (so-called display) of the same device, and in general fully using every function available, not only without requiring to take it out from where it is temporarily placed, but above all without requiring to distract oneself from the activity being performed, much less to interrupt it even temporarily.

BRIEF DESCRIPTION OF THE DRAWINGS

The features of the invention, not emerging from the previous description, will be better highlighted in the following, according to what is claimed and with reference to the appended drawings, in which:

BEST MODE OF CARRYING OUT THE INVENTION

Figures 1, 2:
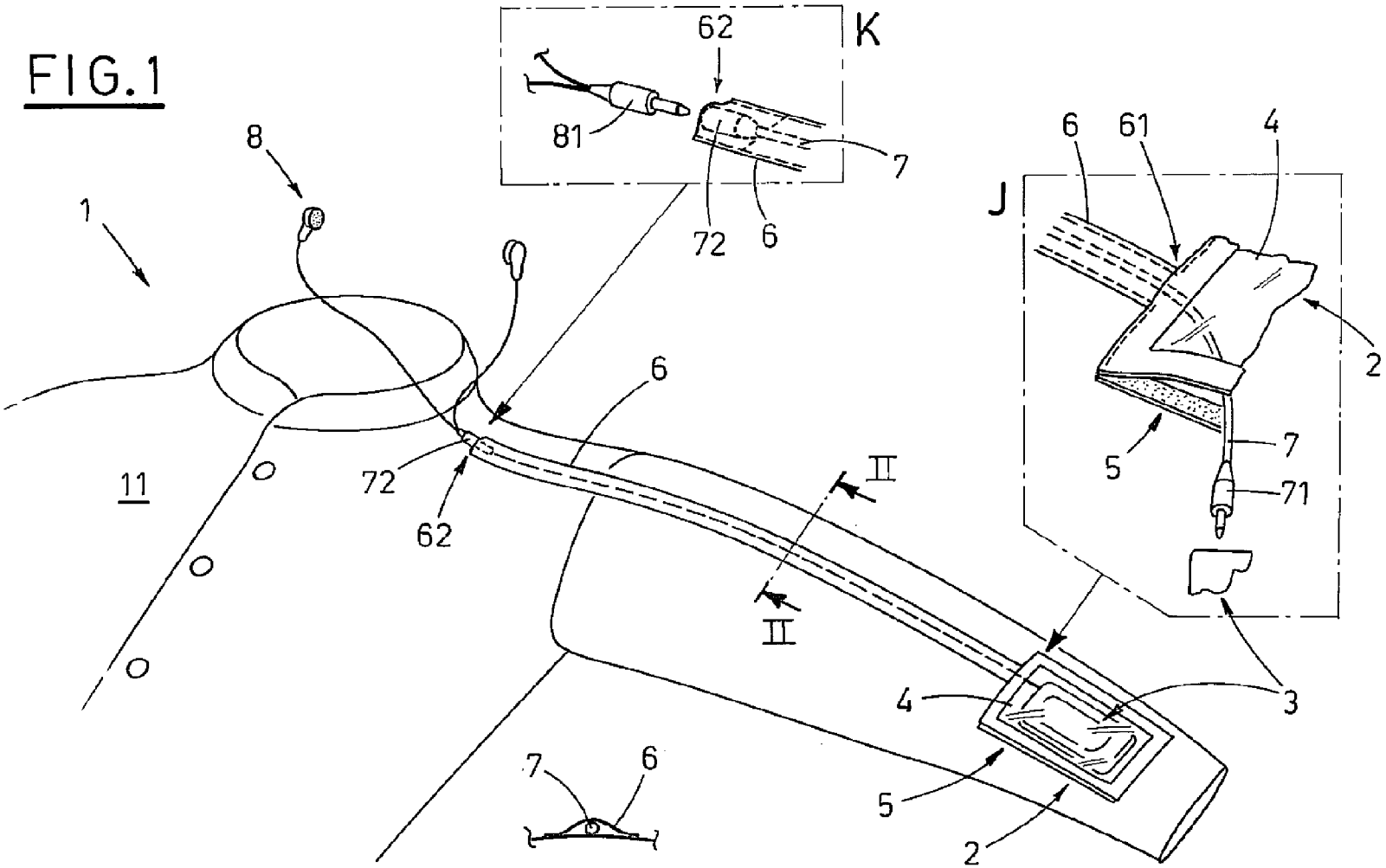
FIG. 1 is a partial schematic view of an article of clothing according to the invention.
FIG. 2 is a cross section schematic view along line II-II of FIG. 1, of a particular technical-functional aspect of the article of clothing according to the preceding figure.

Referring to the appended drawings, the reference number 1 indicates an article of clothing comprising a garment 11 apt to cover at least partially the bust of a user wearing it, and further comprising at least a case 2, which is particularly intended to accommodate at least an electronic device 3 provided with controls for its functioning setting, the case 2 comprising in turn:

- a transparent window 4 which allows to see what is contained in said case 2 and which is deformable so that said user, by manually acting on the same, can actuate said controls, and
- opening and closing means 5, such that the case 2 can be changed from an opening functioning arrangement, in which said electronic device 3 can be alternately either put in or taken out from the case 2, to a closing functioning arrangement in which the electronic device 3 is completely enclosed in the case 2, so that it is prevented from coming out accidentally therefrom.

The case 2 is fixed on the outer side of said garment 11 at either the bust or the upper limbs of the user, in such a position and an arrangement that it is reachable directly by the sight of the user, so that he/she can see therein through the window 4.

In the appended drawings, it is particularly shown a preferred but not limiting embodiment of the invention, which is described in more detail in the following, further exemplary embodiments being enlisted in the description as well.

Said transparent window 4 is preferably realized in plastic material and said opening and closing means 5 are realized by means of the technology commonly known in the market with the Velcro® brand (see box J of FIG. 1, showing the enlarged detail of the portion of the article 1, where it is obtained the case 2).

As it is clear to the experts in the art, other possible opening and closing means 5, fit for the purpose and however falling in the scope of the invention can be: a hinge, a set of snaps etc. . . .

In the preferred embodiment of the invention, said garment 11 is provided with long sleeves and the case 2 is arranged at the distal end of its left sleeve, i.e. near the portion of the wrist (where, for example, it is usually realized a hem or a cuff).

In addition, the case 2 is preferably realized in waterproof material and it is substantially sealed when it is in the closing functioning arrangement.

Therefore, the user can advantageously use the article 1 freely, even in rainy days or abroad of crafts, without the electronic device 3 being subjected to the risks due to its exposure to water or moisture.

According to a preferred technical-functional aspect, the case 2 is suitably stitched on the garment 11, although it is clear that it can be fixed thereto also by means of other means, provided that they are fit for the purpose; these means being not shown here since they are known to the experts in the art.

According to a preferred embodiment shown in the appended drawings, the article 1 comprises a waterproof coulisse 6, obtained in known manner along the left sleeve of the garment 11, whose inner volume communicates in a sealing way with the interior of the case 2 by means of a first buttonhole 61, and with the outside by means of a second buttonhole 62 arranged at the head of the user, said coulisse 6 being apt to accommodate therein a filiform element 7 for the transmission of signals.

Said filiform element 7 is preferably a cable for the electrical transmission of audio signals; it is provided with a waterproof coating and with a male jack 71 at one end and with a female jack 72 at the other end as well, the female jack 72 being realized in stainless material, for example stainless copper; said element 7 being introduced in the coulisse 6, so that said female jack 72 is placed at the second buttonhole 62 and said male jack 71 is placed inside the case 2 (see FIG. 1).

Thanks to these measures, it is possible not only to wear the article 1 including the filiform element 7 in rainy days, but it is even possible to wash the article 1, even in the washing machine, without requiring the need to take out the element 7 from the coulisse 6; this being a surprising advantage with respect to the known technique.

The filiform element 7 is preferably introduced in the coulisse 6, such that it is prevented from coming out accidentally therefrom (see FIG. 2); this being possible, by way of example, by stitching the upper edge of the coulisse on the element 7, which is already suitably arranged on the sleeve of the garment 11, obviously provided that such upper edge is suitably dimensioned.

The functioning is easy and immediate: when the case 2 is in the opening functioning arrangement, the user puts the male jack 71 in the audio output of the electronic device 3, for example a digital audio player (see box J again); then he/she introduces this latter inside the case 2; he/she closes this latter, i.e. places the case 2 in its closing functioning arrangement; and puts a male jack 81 of an earphone device 8 in said female jack 62 (see in particular box K).

Then, for example, the user can go jogging comfortably and without stopping; he/she can at any time select the audio song he/she wants to listen to, by selecting it, by way of example, from a list visible on a display of the device 3; the user being able to read the list perfectly through the transparent window 4, to then start the reproduction of the song, by acting suitably on the functioning controls of the same device 3, by suitably pressing on the window 4, thanks to its advantageous above-described deformability.

in the following there are described further embodiments of the inventive article of clothing 1, which are not described in the appended drawings.

In one of these alternative embodiments, the article 1 is provided with a case 2 dedicated to a particular device 3; the case 2 is virtually provided with an inner shape, which is substantially complementary to the outer one of the article 1, the particular technical-functional aspect being that the transparent and deformable window 4 is provided with an outer shape, that follows the outer one of the functional portion of the article 1, for example the numeric keypad and display, so that the actuation of the functioning controls of the device 3 is more immediate and faster for the user, simply by using the similarity between the outer shape of the window 4 and the respective and underlying control elements.

More exactly, in case the device is a specific cell phone provided with a particular numeric keypad, the window 4 will be also provided with a raised shape of such numeric keypad, so that each button of the phone corresponds, on the upper portion and in strict adherence, to an element of the window 4, which is raised and reproduces its shape, so that when pushing this one, the user actuates immediately and as a consequence the respective underlying button.

According to another possible embodiment of the invention, the case 2 is free from opening and closing means 5, in other words it is always in the closing functioning arrangement, so that the device 3 is always enclosed in the case 2.

Thanks to this measure, it is neither required the device 3 to be usually available in the market, nor is it to be provided with a protective case.

It can simply be made up of the assembly of the circuitry and the electronic elements sufficient to its functioning, which are completely protected by the case 2 which can be shockproof and waterproof, this latter being not provided with any opening communicating with the outside, other than the ones suitable to make accessible to the user the hardware interfaces, as for example, usb ports, audio-video outputs, etc. . . .

According to another embodiment, the article 1 is free of filiform elements 7 for the transmission of signals, so it is even free of coulisse 6, since the article 1 is apt to be connected in a wireless way to other electronic devices, as for example earphones, microphones, etc. . . .

It is intended that the preceding description is purely exemplary and not limiting, therefore possible practical changes or variations are clearly intended to fall in the protective scope of the invention, as above-described and defined by the following claims.

What is claimed:

1. An article of clothing comprising:

a garment (11) configured to cover at least partially a bust of a user wearing the garment, the garment having at least one case (2), configured to accommodate at least one electronic device (3) having controls for setting functions thereof, the case (2) having a transparent window (4) for observing the electronic device disposed in said case (2), the transparent window being disposed adjacent the controls and being deformable so that said user can actuate said controls by acting on and deforming said window, the case (2) being fixed on an outer side of said garment (11), at the bust or upper limbs of the user, in such a position and an arrangement that the user can see the controls through the window (4);

wherein the case (2) has opening and closing apparatus (5), the case being changeable from an opening functioning arrangement in which said electronic device (3) can be alternately put in or taken out from the case (2), to a closing functioning arrangement in which the electronic device (3) is completely enclosed in the case (2), such that the electronic device is prevented from coming out accidentally therefrom;

the garment having a coulisse (6), having an interior having an inner volume which communicates with an interior of the case (2) by a first buttonhole (61), and with an exterior of the case by a second buttonhole (62), a filiform element (7) for transmitting signals therein, said coulisse (6) configured to accommodate the filiform element therein; and, wherein said filiform element (7) is a cable for electrically transmitting signals, the cable provided with a waterproof coating and being made of a stainless material, the cable having a male jack (71) at one end and having a female jack (72) at another end thereof, said cable (7) being accommodated in the coulisse (6) by arranging the cable on a sleeve of the garment, an upper edge of the coulisse stitched onto the cable so that said female jack (72) is fixedly located at the second buttonhole (62), said male jack (71) being located inside the case (2), the upper edge preventing the cable from being removed accidentally from the coulisse (6).

2. The article of clothing according to claim 1, wherein the case (2) is made of a waterproof material.

3. The article of clothing according to claim 1, characterized in that the case (2) is substantially sealed when in the closing functioning arrangement.

4. The article of clothing according to claim 1, wherein said second buttonhole (62) is placed at a head of the user.

5. The article of clothing according to claim 1, characterized in that said interior of the coulisse (6) and said interior of said case (2) sealingly communicate with respect to each other through said first buttonhole (61), said coulisse (6) being made from a waterproof material.

* * * * *